United States Patent [19]

Kjos et al.

[11] 4,010,904

[45] Mar. 8, 1977

[54] GRINDING MILL TRUNNION DISCHARGER TO OPPOSITE FACING SCREENS

[75] Inventors: David M. Kjos, Wauwatosa; Raymond C. Jenness, Milwaukee; Richard E. Sabaski, Hales Corners; Carl A. Roloff, Nashotah, all of Wis.

[73] Assignee: Allis-Chalmers Corporation, Milwaukee, Wis.

[22] Filed: Apr. 19, 1976

[21] Appl. No.: 678,166

[52] U.S. Cl. ..... 241/79.3; 241/171

[51] Int. Cl.[2] ..... B02C 23/10

[58] Field of Search ..... 241/75, 79, 79.2, 79.3, 241/171; 239/687; 209/243, 246, 247, 254; 222/169, 170, 330, 410

[56] References Cited

UNITED STATES PATENTS

| | | | |
|---|---|---|---|
| 1,368,739 | 2/1921 | Lindhard | 241/80 |
| 1,523,435 | 1/1925 | McGregor | 241/75 |
| 1,649,781 | 11/1927 | Kopf | 241/79.2 |
| 3,031,110 | 4/1962 | Verheyden | 222/330 |

*Primary Examiner*—Granville Y. Custer, Jr.
*Attorney, Agent, or Firm*—Robert C. Jones

[57] ABSTRACT

Reversible rotation grinding mills having a radially compartmentalized discharger with direction and volume control to laterally extending screens so as to obtain a constant "cut" of material or slurry flow to stabilize the volume and size consist of the discharge.

7 Claims, 6 Drawing Figures

GRINDING MILL TRUNNION DISCHARGER TO OPPOSITE FACING SCREENS

BACKGROUND OF THE INVENTION

This invention relates to a rotary grinding mill and more particularly to a rotary grinding mill having a trunnion discharger which expels its discharge to a screen.

Grinding mills of the type herein considered are extremely large and often have what is called a "multiple pinion drive." A gear around the shell or trunnion extension is driven through a pinion(s) and possibly a speed reducer(s) by a motor(s) on each pinion drive train for the mill. With this type of arrangement the discharge of the trunnion is normally parallel with the axis of the mill and a single screen. However, one of the problems with a single discharge to a single screen is that the required screening capacity often cannot be obtained with a single screen. It has been proposed to use parallel double screens with the mill discharge divided by a splitter bar which would be adjustable to direct the material from the trunnion onto the dual parallel screens as may be desired. However, while this approach is a workable approach it has not been acceptable in most instances because of the experience industry has had with splitter bar arrangements in which they gradually become incrusted with a buildup of the material or slurry wear resulting in a gradual loss of adjusting capability.

The problem to be solved was to take the discharge of the mill (which is reversible in rotation) and split it evenly both volumewise and sizewise onto multiple vibrating screens. Thus, not only did the drive arrangement to the mill have to be reconsidered and redesigned, but the screens themselves had to be reoriented so that maximum advantage of available screen sizes could be obtained to handle the extremely large volume of mill discharge; with the division more or less of equal size and volume.

SUMMARY OF THE INVENTION

Accordingly, it is an object of this invention to provide a trunnion discharge arrangement which is operable to feed oppositely extending vibrating screens.

It is another object of this invention to provide a trunnion discharge arrangement which is operable to attain a constant "cut" of slurry to stabilize the volume and size consist of the discharge.

Still another object of this invention is to provide a trunnion discharge arrangement wherein excessively undesirable incrustation of the equipment is not experienced.

In the achievement of these objects there is provided in accordance with this invention a trunnion discharger arrangement having a plurality of discharge ports arranged in equi-circumferentially spaced pairs or groups wherein the discharge from one pair or group is effected alternately so as to stabilize the volume of the discharge and the size consist of the discharge. The arrangement operates to provide substantially even distribution of the discharge to oppositely extending screens which is constant both in volume and size consist so that the operation does not vary and the discharge to the screens is maintained at a substantially constant rate. This also includes a matching of discharge ports to cover an odd number of "cut" product streams.

DESCRIPTION OF THE DRAWING

Referring now to the drawings and specifically to FIG. 1 therein, there is shown a grinding mill 10 having a drive gear 11 bolted to the periphery thereof. Arranged on either side of the mill are dual drive arrangements comprising pinions 12 and 12A driven from speed reducers 14 and 14A, respectively. Power input to the reducers 14 and 14A is effected by motors 16 and 16A, respectively. Normally, the mill and its trunnions 17 and 18 are rotationally supported by bearings 19 and 20 in the usual manner so that rotation of the mill by power from the motors 16 and 16A may be effected. Material is fed into the mill via a feed chute 21 which has communication with the interior of the mill through the left-hand trunnion 17. The discharge of material or slurry from the grinding mill 10 is through the trunnion 18 into a discharger 25 which is bolted to the right-hand end of the mill as shown in FIG. 2. The discharge from the discharger 25 is to oppositely extending chutes 26 and 27 which have communication with vibrating screens 28 and 29, respectively. The chutes 26 and 27 are supported by a housing 31 which surrounds the discharger 25. As shown in FIGS. 2 and 3, the discharger comprises a cylindrical shell or housing 33 which is secured to the outer extending edges of radially extending longitudinal wall members 34 to 41, inclusive. The walls are circumferentially spaced about a central tubular core member 42. The inner end of the shell 33 adjacent to the trunnion 18 is bolted or otherwise secured to a relatively large circular plate 44, FIG. 2, which, in turn, is welded or bolted to a circular mounting plate 46 that is secured to the right-hand end of the trunnion as viewed in FIGS. 1 and 2. The circular plate 44 has a center opening 47 of a diameter which is substantially equal to the interior diameter 48 of the trunnion. Thus, a flow path is established between the interior of the trunnion to the discharger 25. The right end or the lower end, as viewed in FIG. 2, of the core member 42 is welded to a circular flange 49 which, in turn, is welded to the inner portion of the associated wall members 34 through 41. The circular flange 49 has an inner circular opening of a diameter equal to the diameter of the core member 42. A circular closure plate 50 having an axial circular opening 51, the diameter of which is equal to the diameter of the core 42, is bolted to the flange 49 and to an outer circular flange 52 which is welded to the end of the shell 33. Thus, access to the interior of the mill 10 is provided through the core member 42. For reason of safety, an access restricting plate 53 is removably fastened to the housing 31 and covers the access opening.

Figure 3:
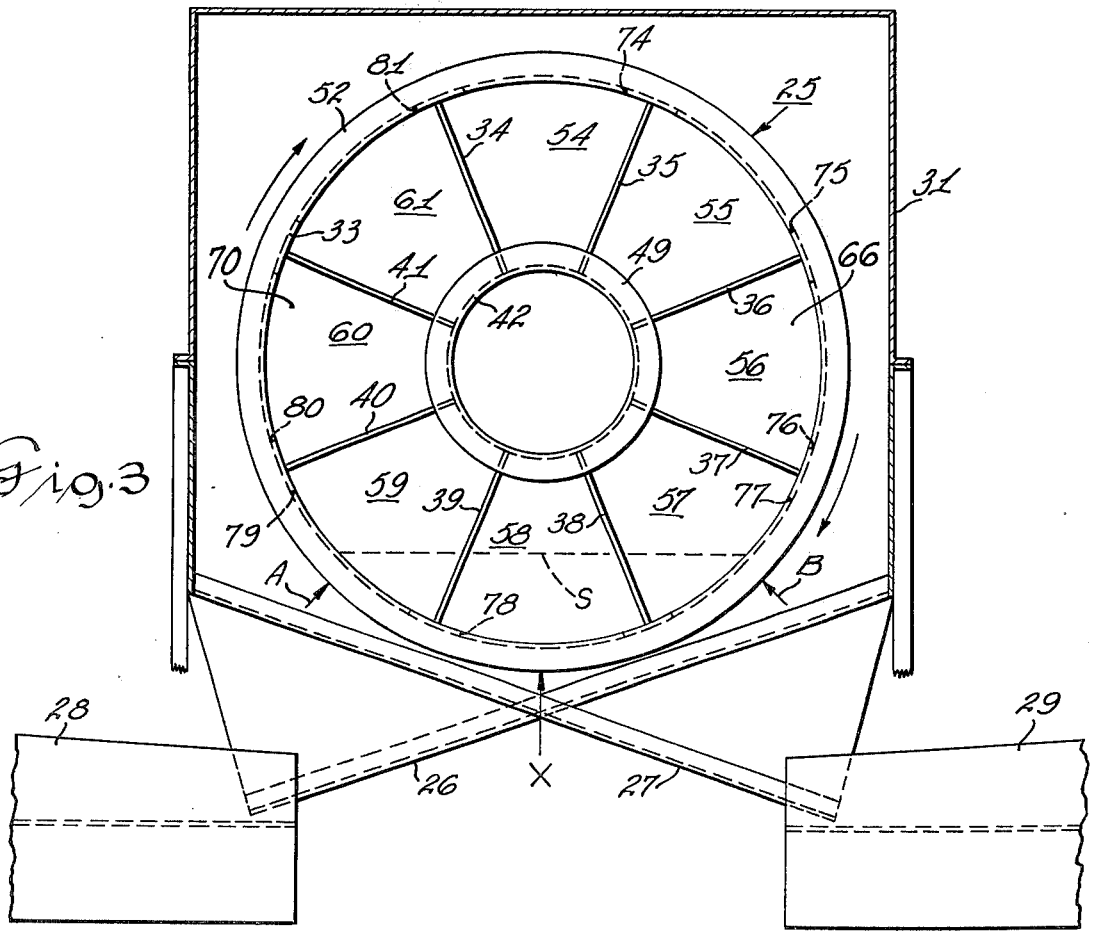
FIG. 3 is an enlarged sectional view in elevation of the trunnion discharge apparatus taken in a plane represented by the line III—III in FIG. 2.

As previously mentioned, the discharger 25 is provided with longitudinally extending walls 34 through 41 which are secured between the core member 42 and the shell 33. These walls serve to define longitudinally extending chambers or compartments which are arranged in diametrically opposed relationship as shown in FIG. 3. Thus, for example, in the particular illustrated device herein set forth, the discharger 25 is divided into eight compartments, 54 through 61.

Figure 1:
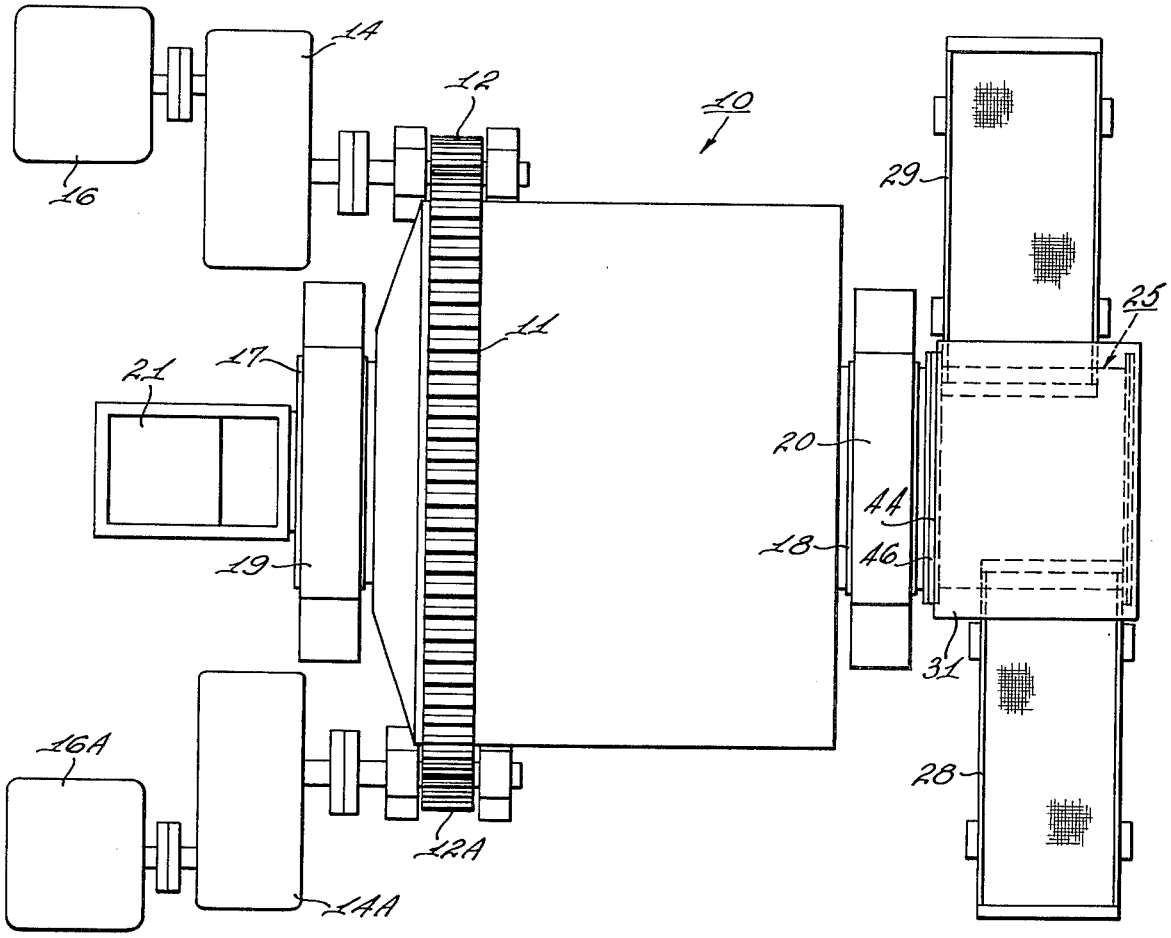
FIG. 1 is a plan view of a grinding mill having a trunnion discharge arrangement in accordance with the present invention.
Figure 4:
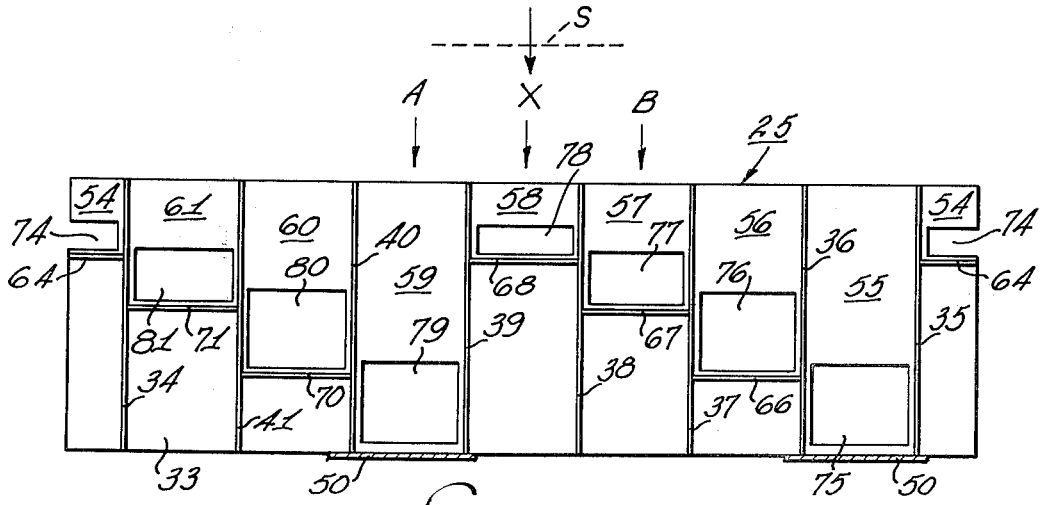
FIG. 4 is a development of the discharger unit of FIG. 3 showing the limits of each of the discharge chutes and the arrangement of the discharge openings therein.
Figure 2:
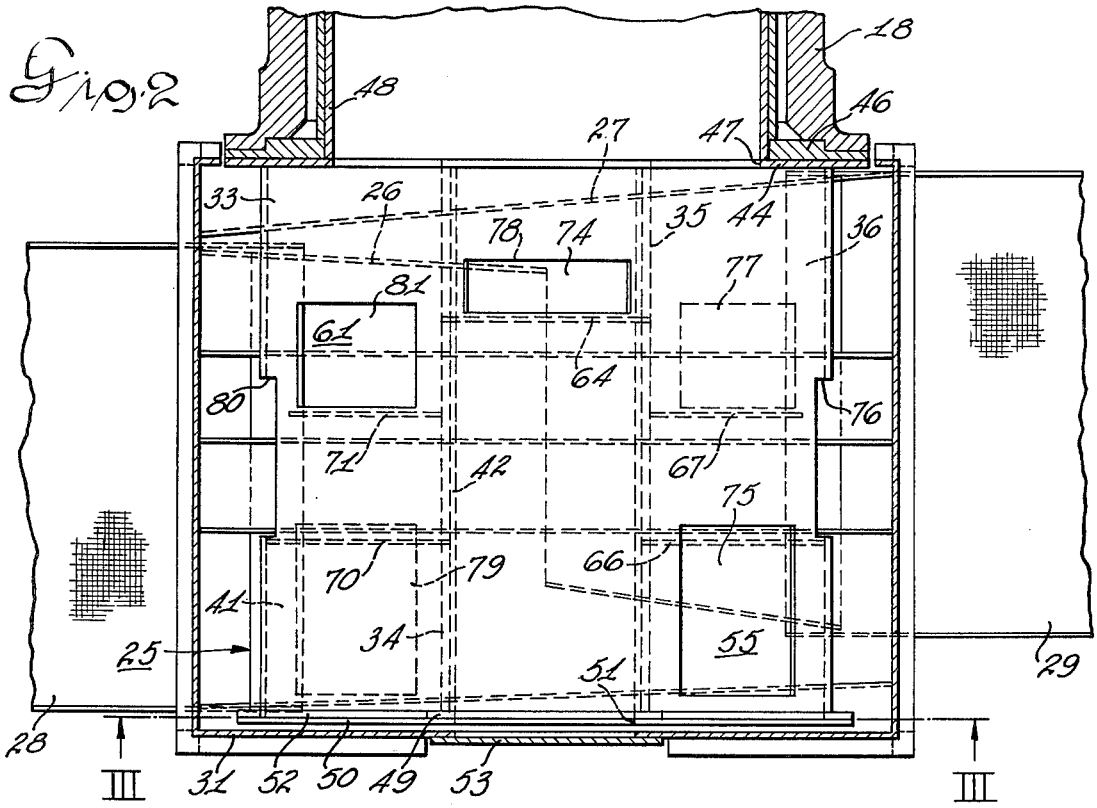
FIG. 2 is an enlarged fragmentary plan view of the trunnion discharger apparatus shown in FIG. 1.

Since the vibrating screens 28 and 29 to which the material or slurry from the mill is to be delivered extend in the diametrically opposite directions and transverse to the direction of slurry flow, the slurry must be made to change its direction of flow from parallel with the mill axis to transverse of it. Also, the volume of the slurry from the mill must be divided between both screens so that a roughly equal volume of the slurry is directed to the respective screens. This is true because the vibrating screens each have a load capacity which is exceeded by the output of the mill 10. To this end, the length of the compartments 54 through 61 are varied. This is accomplished by providing each compartment with a transversely extending baffle or end plate. Thus, for example, compartments 54 and 58 which are diametrically opposite each other have baffles 64 and 68, respectively, as shown in FIG. 4, which is a developed view of the discharger 25. The baffles 64 and 68 limit the length of the compartments 54 and 58 to substantially one-fourth of the length of the discharger 25. Baffles 67 and 71 limit the length of compartments 57 and 61, respectively, to approximately one-half of the discharger length. Baffles 66 and 70 operate to limit the length of the compartments 56 and 60, respectively, to approximately three-quarters of the length of the discharger 25. The compartments 55 and 59 extend the full length of the discharger.

Each of the compartments 54 through 61 is provided with a discharge port 76 through 81, respectively. These ports are located adjacent the associated compartment baffle, as clearly indicated in FIG. 4.

As will be noted in the drawings of FIG. 4, the size of the ports vary depending upon the length of the associated compartment. This is done so that an equal volume of material or slurry material will be contained in each compartment. This is true because the discharger 25 rotates at a constant speed and the material or slurry is flowing out of the grinding mill at substantially a constant velocity. Thus, the ports associated with each compartment must vary according to the length of the compartment. In other words, the compartments with the shortest lengths will have the smallest ports as exemplified by the ports 74 and 78 associated with the compartments 54 and 58, respectively. On the other hand, compartments 55 and 59 have the largest ports as exemplified by the ports 75 and 79, respectively. With this arrangement, the slurry retention time in any compartment will be substantially equal. Thus, as the discharger 25 rotates, the discharge of slurry to the oppositely facing screens will be equal from all ports.

For purposes of this description, it will be assumed that rotation of the grinding mill, and therefore the discharger 25, in a clockwise direction as viewed in FIG. 3. It will also be assumed that the material or slurry flow pattern from the trunnion 18 of the mill to the discharger is as indicated by the broken line S. Thus, compartment 58 at position X will be receiving material or slurry from the trunnion. Likewise, the compartment 57 at position B will be receiving some material or slurry as well as compartment 59 at position A. Since compartment 58 is of relatively short length the slurry received therein will almost immediately be discharged through its associated port 78. Thus, the slurry will discharge from port 78 and will be substantially evenly distributed to chutes 26 and 27 and then to screens 28 and 29. It is true that as the discharger 25 rotates in a clockwise direction, as viewed in FIG. 3, more material or slurry will tend to be discharged to the chute 27. However, it will be appreciated that the slurry entering into compartment 57 at position B has a longer distance to flow in the compartment before it discharges through port 77. Thus, a relatively small amount of material or slurry will discharge through port 77 prior to the compartment being rotated to position X. This relatively small amount of material or slurry which is discharged from compartment 57 prior to the compartment reaching position X is approximately equal to the amount of slurry that discharges to the high side of chute 27 from compartment 58 as it is rotated from position X to position A.

As compartments 58 and 57 are advancing in a clockwise direction, longer compartments 59 and 56 are also being advanced. With respect to compartment 59, it can be seen that in position A the material or slurry level flowing from the trunnion 18 is indicated by the broken line S. Thus, material or slurry will flow into compartment 59 at position A. However, since compartment 59 is a long compartment, the discharge of material or slurry from port 79 will be of a reduced amount and will discharge to the high side of chute 27. Counterbalancing this material or slurry discharge is a discharge from compartment 56 which at a horizontal position tends to discharge any material or slurry remaining in the compartment. This discharge from compartment 56 is via port 76 and will spill to the high side of chute 26.

Similar discharge conditions from the other compartments are experienced. Thus, it is apparent that the discharger 25 operates to distribute the material or slurry from the grinding mill 10 substantially equally to both of the chutes 26 and 27 and thus equally to both screens 28 and 29. The screens therefore need not be overloaded but operate at maximum efficiency.

In addition, compartment exits could be specifically channeled to oppositely directed splitter vanes. This ultimate direction of material exit is not necessarily dependent on rotational position of the discharger. Similarly, the balancing of capacity and consist continues to depend on retention time which is controlled by corresponding port size to baffle position.

Not only does the discharger distribute the slurry substantially equally to both screens, but also effects a change in the direction of slurry flow. With this arrangement, a large size grinding mill having an output capacity well beyond the ability of a single screen can be utilized in a closed system.

Figure 5:
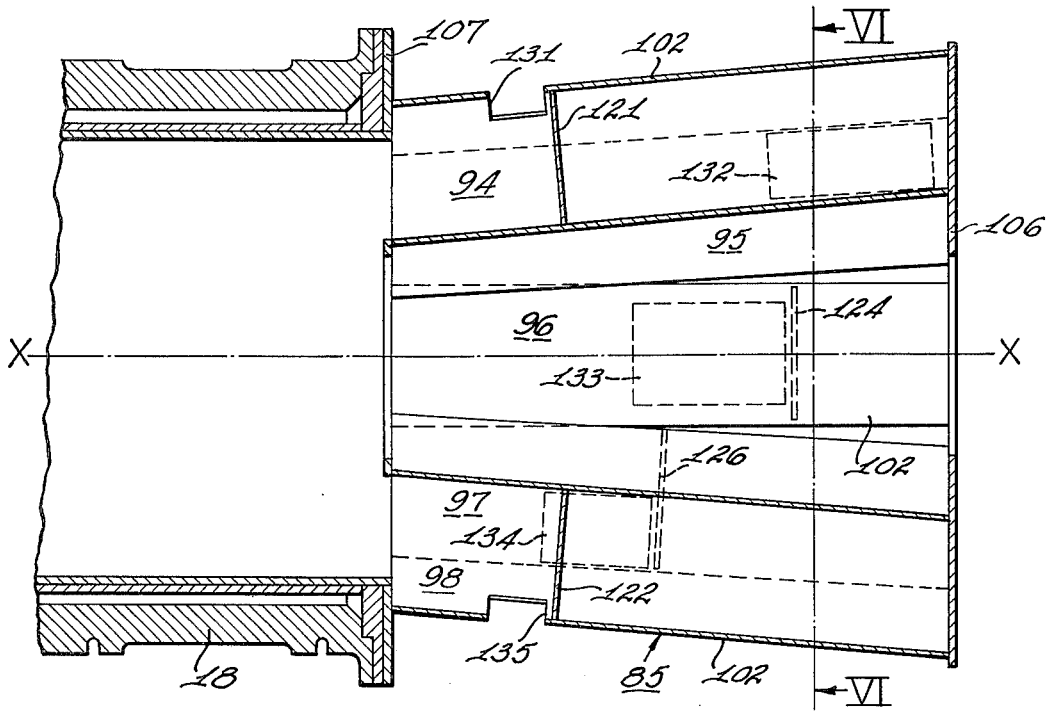
FIG. 5 is a modification of the trunnion discharger apparatus provided with cylindrical type compartments arranged with their axes angularly disposed in relation to the axis of rotation of the discharger; and, FIG. 6 is a sectional view of the modified apparatus taken along lines VI—VI in FIG. 5 showing the compartmentalized arrangement in cylindrical form.
Figure 6:
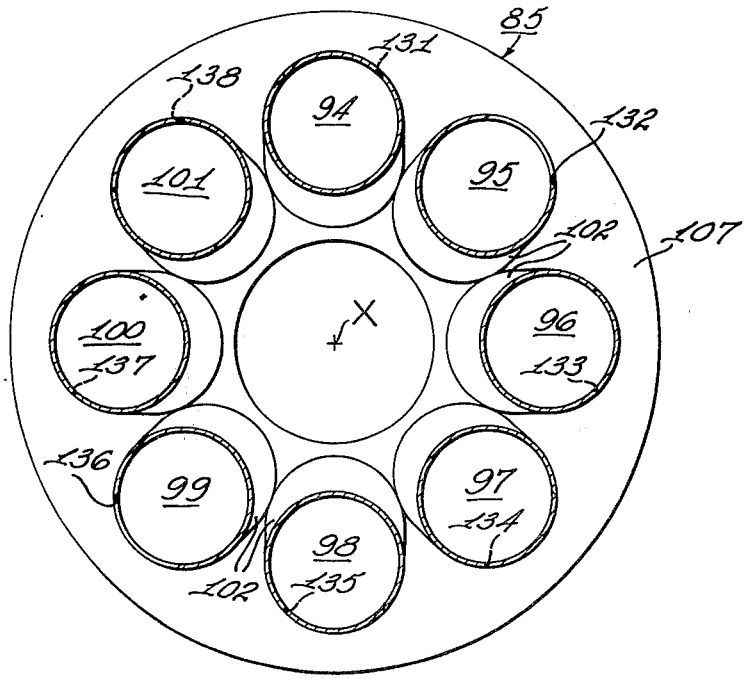

FIGS. 5 and 6 illustrate a modified discharger 85. As shown, discharger 85 is substantially similar to the discharger 25 and varies in construction but not in its operation. In the discharger 85, the compartments 94 through 101 are all formed of commercially available pipe 102 of suitable diameter and length. The outer ends or right ends, as viewed in FIG. 5, of the compartment pipes are secured in a spider 106. The rearwardly ends of the pipes are likewise secured in a spider 107. The arrangement is such that the longitudinal axes of the compartments divert outwardly away from the axis represented by the dash and dot line X-X in FIG. 5, about which the discharger 85 rotates. As in the case of the discharger 25, the compartment lengths of the discharger 85 are also defined by baffles. Thus, compartments 94 and 98 are the shortest compartments and are limited by baffles 121 and 122. Compartments 95 and 99 are the longest compartments and extend the full length of the discharger. The compartments 96 and 100 are shorter in length with respect to compartments 95 and 99. This length is established by baffles exemplified by the baffle 124 associated with compartment 96. Compartments 97 and 101 are shorter than compartments 96 and 100 but longer than compartments 94 and 98. The length of compartments 97 and 101 are defined by baffles exemplified by the baffle 126 associated with the compartment 97.

As in the discharger 25, the compartments associated with the discharger 85 each have ports similar to the ports associated with the discharger 25 compartments. Thus, compartments 94 through 101 have ports 131 through 138 through which material or slurry is discharged in a manner set forth in the description of discharger 25.

An advantage obtainable with the modified discharger 85 is a simplicity of construction and replacement wearing parts utilizing commercially available pipe for the compartments. It is also apparent that with the flaring compartment arrangement, material or slurry flow is promoted or a faster flow is obtained. It is to be understood that the compartments of the discharger 85 need not flare but may be arranged with their axes parallel to the rotational axis X.

The embodiments of the invention in which an exclusive property or privilege is claimed are defined as follows:

1. In a material discharger for a rotatable grinding mill having a discharger end;

a frame having an axis of rotation carried by the grinding mill for rotation with it;

a plurality of compartments carried by said frame for rotation with the frame and around the axis of rotation of said frame material inlet openings in one end of each of said compartments adjacent the discharge end of the grinding mill;

a plurality of vibrating screens disposed below said discharger in position to receive material from the discharger; and, port means in each compartment in position to effect a discharge of material from its associated compartment to said screens as said compartments rotate with said frame about its axis of rotation.

2. A material discharger according to claim 1 wherein said vibrating screens extend in opposite directions which are transverse to the axis of rotation of said frame.

3. A material discharger according to claim 2 wherein said compartments are of different lengths, and the ports associated with individual compartments are of different sizes depending upon the length of the associated compartment, the arrangement being that the ports are progressively sized with the largest size port being associated with the compartment of longest length and the smallest size port being associated with the compartment of least length;

whereby retention time of material in the individual compartments will be substantially equal and substantially equal flow from all ports will be obtained.

4. A material discharger according to claim 3 wherein the compartments of shortest length have the smallest size ports and the compartments of the longest length have the largest size ports and the compartments having lengths between the shortest and longest lengths have ports sized in relation to their lengths.

5. A material discharger according to claim 3 wherein said compartments are fabricated around a central core, said core having communication with the discharge end of the grinding mill so as to serve as an access means to the interior of the grinding mill.

6. A material discharger according to claim 3 wherein said compartments are constructed of cylindrical pipes.

7. A material discharger according to claim 6 wherein said compartments of cylindrical pipes are operatively disposed with their axes on similar angles which intersect the axis about which said discharger rotates and with their outer ends diverging away from the rotational axis of said discharger.

* * * * *